United States Patent [19]

Okada

[11] 4,346,925

[45] Aug. 31, 1982

[54] HANDLE DEVICE OF LID OPENER MECHANISM

[75] Inventor: Yasumasa Okada, Hino, Japan

[73] Assignee: Nissan Motor Co., Ltd., Yokohama, Japan

[21] Appl. No.: 166,690

[22] Filed: Jul. 2, 1980

[30] Foreign Application Priority Data

Jul. 5, 1979 [JP] Japan ..... 54-84441

[51] Int. Cl.[3] ..... E05C 7/00

[52] U.S. Cl. ..... 292/336.3

[58] Field of Search ..... 292/28, 38, 50, 125, 292/171, 225, 336.3, DIG. 25

[56] References Cited

U.S. PATENT DOCUMENTS

| | | | |
|---|---|---|---|
| 3,249,379 | 5/1966 | Ross | 292/336.3 X |
| 3,253,481 | 5/1966 | Warhol | 74/501 |
| 3,369,427 | 2/1968 | Brighton et al. | 74/501 |
| 3,891,042 | 6/1975 | Braun | 180/6.48 |
| 4,054,307 | 10/1977 | Carella et al. | 292/50 |

FOREIGN PATENT DOCUMENTS

| | | |
|---|---|---|
| 289108 | 4/1928 | United Kingdom . |
| 427262 | 4/1935 | United Kingdom . |
| 1508155 | 4/1978 | United Kingdom . |
| 154015 | 6/1979 | United Kingdom . |

*Primary Examiner*—Richard E. Moore

*Attorney, Agent, or Firm*—Lowe, King, Price & Becker

[57] ABSTRACT

In a lid opener mechanism including two locking devices for respectively locking two lids, and two control wires respectively connected at their one ends to the two locking devices for making the locking devices inoperative when pulled in a given direction, there is provided a handle device for operating the control wires. The handle device comprises a supporter stationarily arranged at a position far from the two locking devices, a single lever swingably arranged on the supporter and having one end forking into first and second work portions, at least one spring spanned between the supporter and the lever to bias the lever to take a predetermined neutral position, and two pins which are arranged to connect the other ends of the control wires to the first and second work portions of the lever, whereby when the lever is swung in a direction against the force of the spring causing one of the first and second work portions to pull the corresponding control wire in the given direction, the correspondng locking device becomes inoperative thereby to unlock the corresponding lid.

10 Claims, 10 Drawing Figures

HANDLE DEVICE OF LID OPENER MECHANISM

FIELD OF THE INVENTION

The present invention relates in general to automotive lid opener mechanism for remotely handling opening operation of the automotive lids such as trunk lids or fuel filler lids, and more particularly to a manually operated handle device of the lid opener mechanism.

SUMMARY OF THE INVENTION

According to the present invention, there is provided an improved handle device of the lid opener mechanism. The lid opener mechanism includes two locking devices for respectively locking two lids, and two control wires respectively connected at their one ends to the two locking devices for making the locking devices inoperative when pulled in a given direction. The handle device comprises a supporter stationarily arranged at a position far from the two locking devices, a single lever having one end forking into first and second work portions, swingable means for swinging the single lever relative to the supporter, biasing means for biasing the lever to take a predetermined neutral position, and connecting means for connecting the other ends of the control wires to the first and second work portions of the lever respectively. When the lever is swung in a direction against the force of the biasing means causing one of the first and second work portions to pull the corresponding control wire in the given direction, the corresponding locking device becomes inoperative thereby to unlock the corresponding lid.

It is an object of the present invention to provide an improved handle device or automotive lid opener mechanism, which has a single lever of which swinging movement in a direction induces unlocking of a lid and of which swinging movement in the other direction induces unlocking of another lid.

Other objects and advantages of the present invention will be clear from the following description when taken in conjunction with the accompanying drawings.

DESCRIPTION OF PRIOR ART

Figure 1:
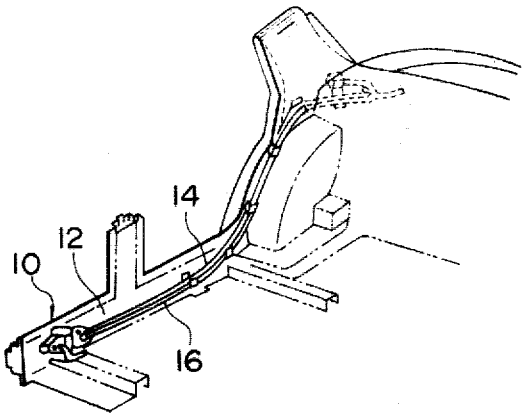
FIG. 1 is a perspective view of a lid opener mechanism equipped in an automotive body.
Figure 2:
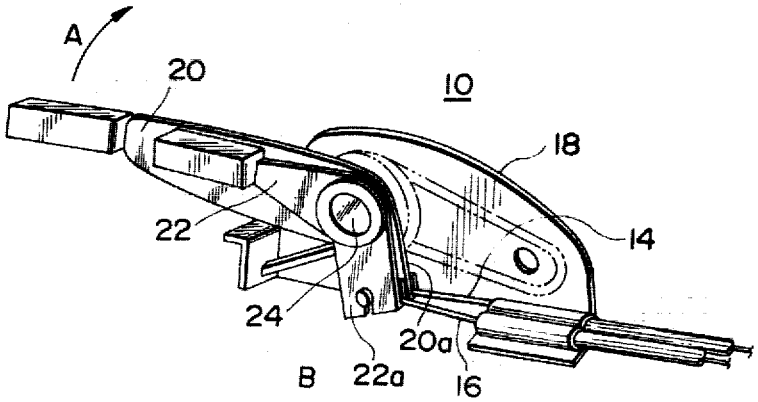
FIG. 2 PRIOR ART
FIG. 2 is a perspective view of a conventionally used handle device employed in the lid opener mechanism.

Prior to describing in detail the handle device of the lid opener mechanism of the present invention, the construction of a conventionally used handle device will be outlined with reference to FIGS. 1 and 2 in order to clarify the invention.

FIG. 1 illustrates schematically conventional lid opener mechanism equipped in an automotive body, the mechanism being constructed to remotely control opening operation of both a trunk lid (not shown) and a fuel filler lid (not shown). The mechanism comprises a handle device 10 fixed to a side sill 12 beside a front seat (not shown) of the vehicle. Two control wires 14 and 16 extend along the side sill 12 with their one ends operatively connected to the handle device 10 and their other ends connected respectively to locking devices (not shown) of the trunk lid and the fuel filler lid.

Referring to FIG. 2, the handle device 10 is shown on a large scale. As shown, the device 10 comprises a base plate 18 fixed to the side sill 12. Longer and shorter operating levers 20 and 22 are swingably connected to the base plate 18 via a common pivot shaft 24. The levers 20 and 22 have respective work portions **20*a* and 22*a* to which the control wires 14 and 16 are connected, respectively. Thus, when the longer lever 20 is swung in the direction of A permitting the work portion 20*a* to rotate in the direction of B, the control wire 14 is moved leftwardly in the drawing unlocking the trunk lid. Similarly to this, when the shorter lever 22 is swung in the direction of A, the control wire 16** is moved leftwardly unlocking the fuel filler lid.

In the conventional handle device 10 mentioned above, however, the following drawbacks are encountered:

First, since the two levers 20 and 22 are positioned close to each other and the lid opening operations are made by swinging the levers 20 and 22 in the same directions, there is a high possibility of misoperation in handling the levers 20 and 22.

Second, since handling of the shorter lever 22 requires larger operation force as compared with that of the longer lever 20, the operator is compelled to handle the two levers 20 and 22 with unbalanced operation forces. This decreases manipulability of the handle device.

Third, because of increased number of parts, it is difficult to miniaturize the handle device and the production cost of it is increased.

Thus, elimination of the above-mentioned drawbacks is the essential object of the present invention.

DESCRIPTION OF THE PREFERRED EMBODIMENTS

Referring to FIGS. 3A, 3B, 4 and 5, there is shown a handle device of the lid opener mechanism, of the first embodiment, according to the present invention. The handle device 26 comprises a single lever 28 which has one end formed into a grip 30 and the other end forking into first and second branch or work portions 32 and 34. Each of the branch portions 32 and 34 is bent to have a generally U-shaped cross section. Pins 36 and 38 are fixed to the work portion 32 and 34 in a manner to transversely cross the U-shaped portions of the same. Two control wires 14 and 16 are respectively connected to the pins 36 and 38, and these wires 14 and 16 extend therefrom and connect at their leading ends with respective known locking devices of the trunk lid (not shown) and the fuel filler lid (not shown). The lever 28 is swingably supported at the first and second branch portions 32 and 34 on a supporter unit of which construction will be described hereinnext.

The supporter unit 40 comprises a substantially flat base plate 42 and an auxiliary plate 44 which are constructed as a unit. As will be seen from FIGS. 3A and 3B, the auxiliary plate 44 has a major portion 44*a* spaced from the base plate 42 and two arm portions 44*b* welded to the base plate 42. The auxiliary plate 44 has two recesses 44*a*-1 and 44*a*-2. Although not well shown in the drawings, the base plate 42 also has two recesses at positions corresponding to the recesses 44*a*-1 and 44*a*-2 of the auxiliary plate 44 so that first and second (or upper and lower) bearing sections are formed on the supporter unit 40. As will become clear as the description proceeds, the pins 36 and 38 of the lever 28 are rested at their both ends on the first and second bearing sections of the supporter unit 40 when the lever 28 is in a neutral position. A spring 46 is spanned between the branched portion of the lever 28 and the supporter unit 40 for enforcedly holding the lever 28, more particularly the branched portion of the lever 28 on the supporter unit 40. A wire clamping plate 48 having two parallelly extending grooves (no numerals) is fixed by a bolt 50 to a major portion of the base plate 42 in such a manner that sleeves 14*a* and 16*a* of the control wires 14 and 16 are retained between the clamping plate 48 and the base plate 42, being accommodated in the respective grooves of the clamping plate 48. Now, it should be noted that the bolt 50 passes through respective openings formed in the clamping plate 48 and the base plate 48 and is screwed in an opening of the side sill 12 for retaining these parts to the side sill 12. Designated by numeral 52 is a nut which is welded to the side sill 12. As is seen from FIG. 5, the base plate 42 has a lug 42*a* which is formed by cutting and raising a portion of the base plate 42. The clamping plate 48 has also a lug 48*a* which is formed by raising an extreme end of the plate 48. These lugs 42*a* and 48*a* are respectively projected into or engaged with an opening 12*a* formed in the side sill 12 and an opening 42*a* formed in the base plate 42, the opening 42 being a trace of forming the lug 42*a*. With the engagements of the lugs 42*a* and 48*a* with the openings 12*a* and 42*a*, rotational movements of the base plate 42 and the clamping plate 48 relative to the side sill 12 are assuredly prevented even when the bolt 50 is turned to fasten these plates to the side sill 12.

Figure 3A:
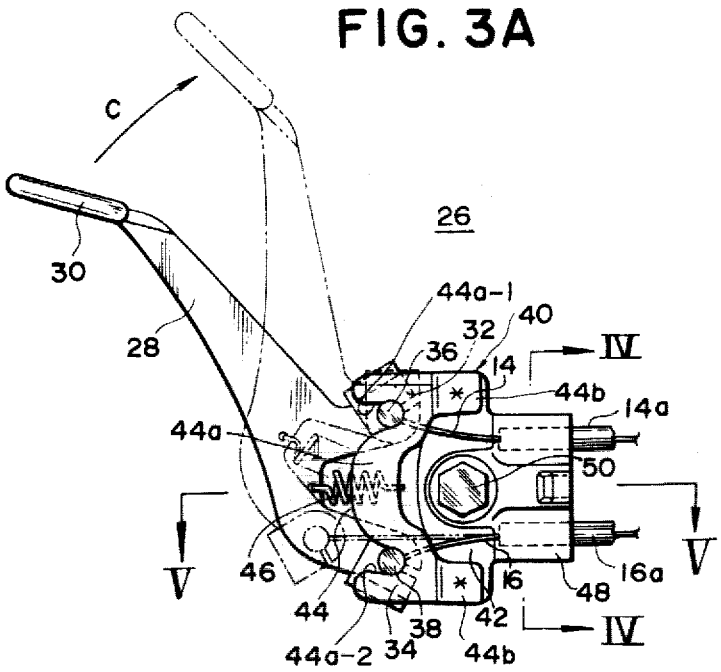
FIGS. 3A and 3B are front views of a handle device of the first embodiment according to the present invention, respectively showing a condition by phantom lines wherein a lever of the handle device is swung in the direction of C, and a condition by phantom lines wherein the lever is swung in the direction of D.

In operation, when the lever 28 is forced to swing in the direction of "C" against the force of the spring 46, that is in the direction from the neutral position illustrated by solid lines to the position illustrated by phantom line as shown by FIG. 3A, the lever 28 is swung about the pin 36, pulling control wire 16 leftwardly in the drawing, while keeping the other control wire 14 unmoved, so that only the locking device of the fuel filler lid becomes inpertive.

Figure 3B:
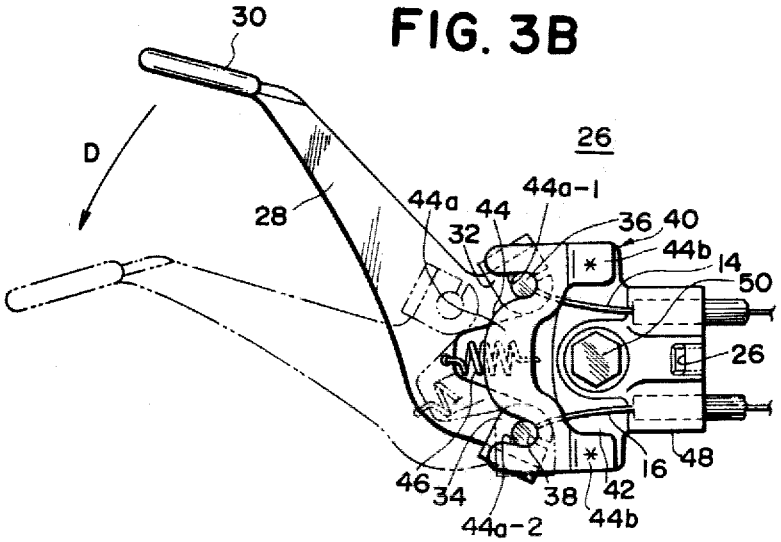
Figure 4:
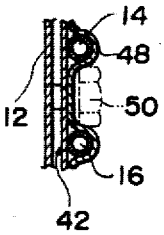
FIG. 4 is a sectional view taken along the line IV—IV of FIG. 3A.
Figure 5:
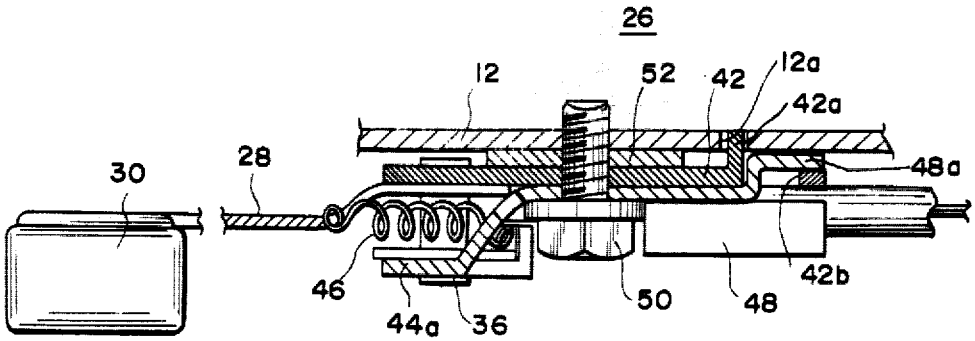
FIG. 5 is a sectional view taken along the line V—V of FIG. 3A.

While, when the lever 28 is forced to swing in the direction of "D" as shown by FIG. 3B, the lever 28 is swung about the pin 38, pulling the control wire 14 leftwardly in the drawing, keeping the control wire 15 unmoved, so that only the locking device of the trunk lid becomes inoperative.

Now, it should be noted that upon releasement of the lever, the lever 28 automatically returns to its neutral position from its operating position by the force of the spring 46.

Figure 6:
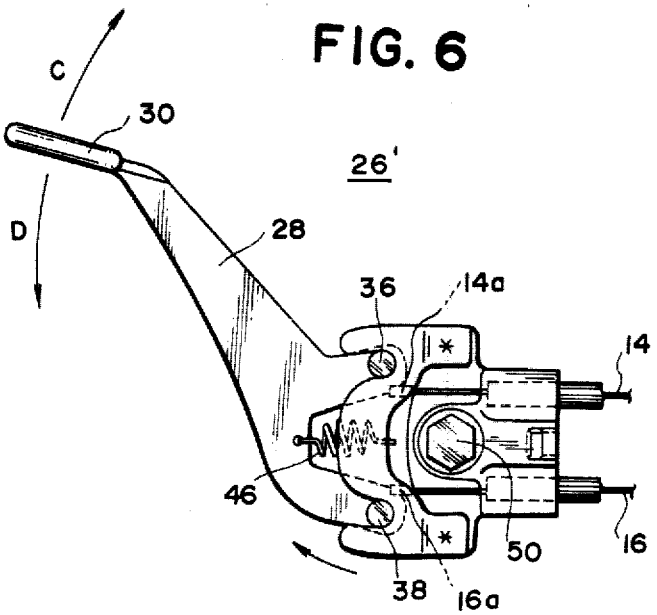
FIG. 6 is a front view of a handle device of the second embodiment according to the present invention.

Referring to FIG. 6, there is shown the second embodiment of the present invention. The handle device 26' of this embodiment is substantially the same in construction as the device 26 of the first embodiment except for the connecting manner of the control wires 14 and 16 to the lever 28. In the second embodiment, the control wires 14 and 16 are directly fixed to the first and second branch portions, not via the pins 36 and 38. However, the point to which an attention should be paid is that the ends 14*a* and 16*a* of the wires 14 and 16 are fixed to the branch portions near the pins 36 and 38 as close as possible. Those skilled in the art will readily recognize that the operation of the second embodiment of FIG. 6 is identical to that of the first embodiment of FIGS. 3A, 3B, 4 and 5.

Figure 7A:
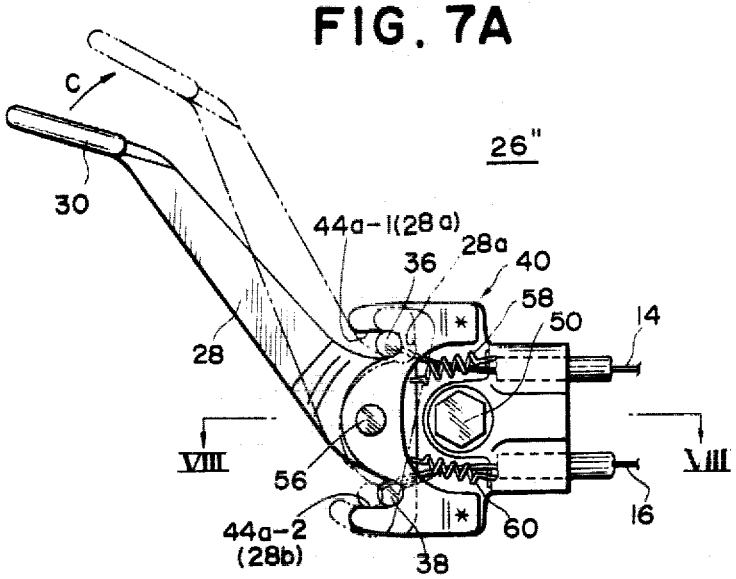
FIGS. 7A and 7B are front views of a handle device of the third embodiment according to the present invention, respectively showing a condition by phantom lines wherein a lever of the handle device is swung in the direction of C, and a condition by phantom lines wherein the lever is swung in the direction of D.
Figure 7B:
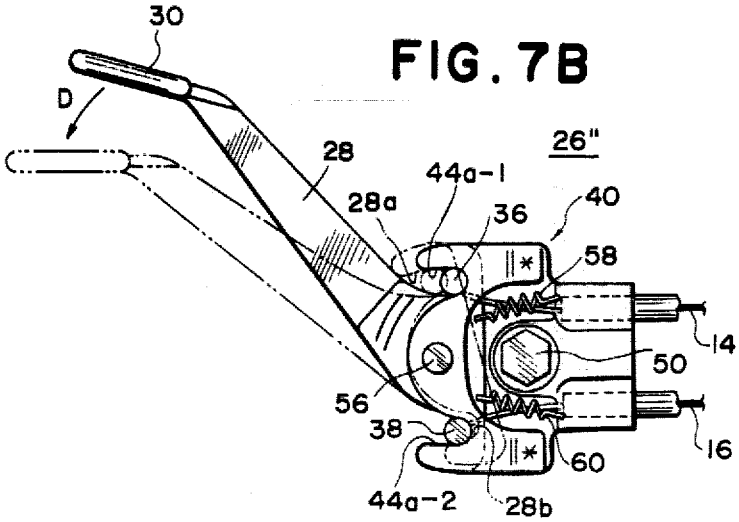
Figure 8:
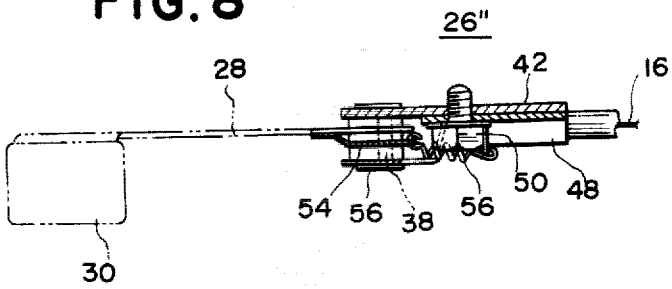
FIG. 8 is a sectional view taken along the line VIII—VIII of FIG. 7A.

Referring to FIGS. 7A, 7B and 8, there is shown the third embodiment of the present invention. The handle device 26" of the third embodiment comprises a single lever 28 which has one end formed into a grip 30 and the other end forking into first and second branch or work portions 32 and 34. As will be understood from FIG. 8, the branched portion of the lever 28 is provided with an auxiliary plate 54 to form a double plate construction thereof. The doubly constructed branch portions 32 and 34 are formed with recesses 28*a* and 28*b* each facing leftwardly in FIG. 7A or 7B. As will become clear as the description proceeds, pins 36 and 38 to which the control wires 14 and 16 are fixed are not fixed to the branched portions 32 and 34 but movably accommodated in the recesses 28*a* and 28*b*. The lever 28 is swingably connected to the supporter unit 40 in a manner as will be described hereinnext.

The supporter unit 40 has substantially the same construction as that of the first embodiment. For facilitation of the drawing, illustration of the side sill (12), the nut (52) welded to the side sill, both lugs (42*a*) and (48*a*) of the base plate (42) and the clamping plate (48) is omitted from FIG. 8. The lever 28 is swingably connected at the branched portion thereof via a pivot pin 56 to the supporter unit 40, with the pins 36 and 38 rested at their both ends on the first and second bearing sections of the supporter unit 40. In case of the lever 28 taking its neutral position as illustrated by solid lines in FIG. 7A or 7B, the recesses 28*a* and 28*b* of the branched portion of the lever 28 are in alignment with the first and second bearing sections (44*a*-1 and 44*a*-2) of the supporter unit 40, and the pins 36 and 38 are rested on the first and second bearing sections, respectively. Two springs 58 and 60 are spanned between the branched portion of the lever 28 and the base plate 42 of the supporter unit 40 so that the lever 28 is biased to take its neutral position illustrated by solid lines in FIG. 7A or 7B.

In operation, when the lever 28 is forced to swing in the direction of "C" of FIG. 7A against the force of the spring 60, that is in the direction from the neutral position illustrated by solid lines to the position illustrated by phantom lines as shown by FIG. 7A, the lever 28 is swung about the pivot pin 56, causing the bottom of the recess 28*b* of the lever 28 to push the pin 38 leftwardly thereby moving the control wire 16 leftwardly in the drawing, while keeping the other control wire 14 unmoved so that only the locking device of the fuel filler lid becomes inoperative. Under this condition, the pin 36 to which the control wire 14 is fixed is kept rested on the first bearing section (44*a*-1) of the supporter unit 40, thereby keeping the control wire 14 unmoved.

While, when the lever 28 is forced to swing in the direction of "D" as shown by FIG. 7B, the lever 28 is swung about the pivot pin 56, causing the bottom of the recess 28*a* of the lever 28 to push the pin 36 leftwardly thereby moving the control wire 14 leftwardly in the drawing, while keeping the other control wire 16 unmoved so that only the locking device of the trunk lid becomes inoperative. Under this condition, the pin 36 to which the control wire 16 is fixed is kept rested on the second bearing section (44*a*-2) of the supporter unit 40, thereby keeping the control wire 16 unmoved.

Now, if desired, arcuate slots may be formed in the doubly constructed branch portions 32 and 34 as a substitute for the recesses 28*a* and 28*b* in the third embodiment. In this modification, the pins 36 and 38 are movably accommodated in the slots.

Although in the above, the description is directed to only the mechanism for actuating the trunk lid and the fuel filler lid, the scope of the invention is applicable to other automotive lids.

What is claimed is:

1. In a lid opener mechanism including two locking devices for respectively locking two lids, and two control wires respectively connected at their one ends to said two locking devices for making said locking devices inoperative when pulled in a given direction, a handle device for operating said control wires, comprising:

a supporter stationarily arranged at a position far from said two locking devices;

a single lever having one end forking into first and second work portions;

swinging means for swinging said single lever relative to said supporter;

biasing means for biasing said lever to take a predetermined neutral position; and connecting means for connecting the other ends of said control wires to said first and second work portions of said lever respectively, whereby when said lever is swung in a direction against the force of the biasing means causing one of said first and second work portions to pull its corresponding control wire in the given direction, the corresponding locking device becomes inoperative thereby to unlock the corresponding lid.

2. A handle device as claimed in claim 1, in which said pivotting means comprises means for defining two recesses in said supporter and two pins respectively fixed to said first and second work portions, said single lever being arranged on said base member with said two pins accommodated in said two recesses.

3. A handle device as claimed in claim 2, in which the other ends of said control wires are respectively connected to said two pins to act as said connecting means.

4. A handle device as claimed in claim 2, in which the other ends of said control wires are respectively and directly connected to said first and second work portions at positions adjacent to the corresponding pins.

5. A handle device as claimed in claim 1, in which said swinging means comprises a pivot pin arranged between said base member and said single lever, and in which said connecting means comprises first means for defining two recesses in said base member, second means for defining a recess in each of said first and second work portions, the recesses of said first means being in alignment with the recesses of said second means respectively when said lever takes said predetermined neutral position, and two pins each being in sliding engagement with both one of the recesses of said first means and one of the recesses of said second means when said lever takes the predetermined neutral position, the other ends of said control wires being respectively connected to said two pins.

6. A handle device as claimed in claim 1, in which said biasing means comprises at least one compression spring spanned between said base member and said single lever.

7. A handle device as claimed in claim 2, in which each of said first and second work portions of said lever is formed to have a generally U-shaped cross section, each of said pins transversely crossing the U-shaped portion of the corresponding work portion.

8. In a lid opener mechanism including two locking devices for respectively locking two lids, and two control wires respectively connected at their one ends to said two locking devices for making said locking devices inoperative when pulled in a given direction, a handle device for operating said control wires, comprising:

a supporter stationarily arranged at a position far from said two locking devices, said supporter having two spaced recesses, a single lever having one end forking into first and second work portions;

two pins respectively fixed to said first and second work portions; and a spring spanned between said supporter and said lever for biasing said lever and thus said pins to be brought into sliding engagement with said two recesses respectively, wherein the other ends of said control wires are respectively connected to said two pins.

9. In a lid opener mechanism including two locking devices for respectively locking two lids, and two control wires respectively connected at their one ends to said two locking devices for making said locking devices inoperative when pulled in a given direction, a handle device for operating said control wires, comprising:

a supporter stationarily arranged at a position far from said two locking devices, said supporter having two spaced recesses;

a single lever having one end forking into first and second work portions;

two pins fixed to said first and second work portions respectively; and a spring spanned between said supporter and said single lever for biasing said lever and thus said pins to be brought into sliding engagement with said two recesses respectively, wherein the other ends of said control wires are respectively and directly fixed to said first and second work portions at positions adjacent to the corresponding pins.

10. In a lid opener mechanism including two locking devices for respectively locking two lids, and two control wires respectively connected at their one ends to said two locking devices for making said locking devices inoperative when pulled in a given direction, a handle device for operating said control wires, comprising:

a supporter stationarily arranged at a position far from said two locking devices, said supporter having two spaced recesses;

a single lever having one end forking into first and second work portions, each of said work portions having a recess;

a pivot pin for pivotably supporting said lever on said supporter;

two springs each spanned between said lever and said supporter to bias said lever to take a predetermined neutral position where the recesses of said first and second work portions are in alignment with the recesses of said supporter in one to one relation; and two pins each being in sliding engagement with the aligned two recesses of said lever and said supporter, wherein the other ends of said control wires are respectively connected to said pins.

* * * * *